US006517067B2

(12) United States Patent
Cruz

(10) Patent No.: US 6,517,067 B2
(45) Date of Patent: Feb. 11, 2003

(54) SHEET MATERIAL REGISTRATION APPARATUS AND METHOD

(75) Inventor: Israel Cruz, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/800,635

(22) Filed: Mar. 6, 2001

(65) Prior Publication Data

US 2002/0125631 A1 Sep. 12, 2002

(51) Int. Cl.[7] ..... B65H 1/04; B65H 1/14
(52) U.S. Cl. ..... 271/207; 271/220; 271/241
(58) Field of Search ..... 271/207, 220, 271/241

(56) References Cited

U.S. PATENT DOCUMENTS

| | | | | | |
|---|---|---|---|---|---|
| 3,860,233 | A | * | 1/1975 | Wiase | 271/239 |
| 4,260,149 | A | * | 4/1981 | Melzer | 271/195 |
| 4,264,068 | A | * | 4/1981 | Melzer | 271/241 |
| 4,541,626 | A | * | 9/1985 | Millen | 271/113 |
| 5,301,938 | A | * | 4/1994 | Casper | 271/236 |
| 5,513,839 | A | * | 5/1996 | Green | 270/58.07 |
| 6,116,594 | A | * | 9/2000 | Boost | 271/236 |

* cited by examiner

*Primary Examiner*—Donald P. Walsh
*Assistant Examiner*—Jonathan R. Miller

(57) ABSTRACT

An imaging system includes a roller assembly adapted to guide sheet material in the system into an accumulator and a sheet registration assembly. The registration assembly includes a lateral fence extending along a first edge of the accumulator. The lateral fence is adapted to contact a lateral edge of sheets fed into the accumulator. A longitudinal fence extends along a second edge of the accumulator. The longitudinal fence is adapted to contact a longitudinal edge of sheets fed into the accumulator. A fixed cam is included in the roller assembly. A rotatable registration finger is mounted in contact with the cam. During rotation of the registration finger, interaction between the registration finger and the cam causes the registration finger to contact each sheet fed into the accumulator by the roller, and to exert force to urge each sheet toward the lateral fence and the longitudinal fence of the accumulator. In an embodiment, the roller assembly includes a selectively rotating shaft. The cam is fixed with respect to the shaft, and the registration finger is mounted on the shaft. The registration finger can include a collar secured to the shaft, with a finger member adapted for contact with sheet material connected to the collar and a cam follower adapted for contact with the cam. The registration finger can be fabricated from a flexible plastic material, and the cam can be provided as a shaft bushing. A biasing mechanism can secured between the registration finger and the cam. The biasing mechanism can be provided as a compression spring biasing the registration finger into contact with the cam. A method of improving sheet registration in an imaging system including a roller assembly adapted to feed sheet material in the system into an accumulator is also provided.

20 Claims, 3 Drawing Sheets

SHEET MATERIAL REGISTRATION APPARATUS AND METHOD

FIELD OF THE INVENTION

The present invention relates generally to imaging systems with accumulators. Specifically, the present invention relates to improving registration of sheets gathered in accumulators of imaging systems.

BACKGROUND OF THE INVENTION

Imaging systems such as printers, fax machines, scanners, and copiers are virtually omnipresent, and can be found in homes and offices worldwide. The development of such systems has facilitated improvements in communication that have in turn fostered an enormous change in the way people live and work. Telecommuting, paperless offices, and intra-office networks represent but a few examples of the advancements that have been made possible by modern imaging systems.

Since these systems have become crucial to everyday existence, their reliability and smooth operation is paramount. It is therefore vitally important to design imaging systems so that downtime and work interruptions are minimized. This can be a daunting challenge, given the relative complexity of systems in which sheet material must be infed, moved through the imaging process, and outfed in a matter of seconds, or fractions of a second. The challenge is further complicated by the fact that humans are operating the system, thus introducing the factor of operator error as a source of problems.

During operation of such imaging systems, it is typical for a plurality of sheets to be gathered together at a processing station commonly called an "accumulator". As the sheets are fed individually into the accumulator, slight differences in sheet sizes, weight, thickness, and/or surface textures can cause misalignment, or improper registration, between sheets in the accumulated stack. For each combination of these factors, successful transportation and registration of sheet material depends upon applying the proper amount of applied force on the sheet with a feed mechanism such as a roller.

It is not unusual for sheets handled by feed mechanisms to be at least somewhat out of registration. Consequently, the art reflects mechanisms known as "joggers" to improve registration in the accumulator itself. A typical jogger arrangement is discussed in U.S. Pat. No. 5,072,920 to Kubota et al. This patent is directed to a finisher for an image forming apparatus for stapling or otherwise finishing paper sheets which are sequentially driven out of an image forming apparatus such as a copier or a printer. The finisher is capable of stapling a stack of paper sheets at any desired position or positions of the sack. A pair of reference fences and a pair of jogger fences are provided on a paper receiver for positioning paper sheets in an intended direction of paper transport and a direction perpendicular thereto, respectively. The reference fences and the jogger fences are reciprocatingly movable in a predetermined direction independently of each other, and each is movable in a symmetrical relation. The jogger fences move independently of a stapler, while the reference fences move along with the stapler by being connected to latter.

While known mechanisms are reasonably effective in improving sheet registration, they are accompanied by several drawbacks. For example, joggers usually require additional motors or transmissions, adding to the cost and complexity of the system. Increased complexity frequently means increased service costs and decreased reliability.

It can thus be seen that the need exists for simple, inexpensive, sheet registration mechanism in imaging systems having accumulators.

SUMMARY OF THE INVENTION

These and other objects are achieved by providing, in an imaging system including a roller assembly adapted to guide sheet material in the system into an accumulator, a sheet registration assembly. The registration assembly includes a lateral fence extending along a first edge of the accumulator. The lateral fence is adapted to contact a lateral edge of sheets fed into the accumulator. A longitudinal fence extends along a second edge of the accumulator. The longitudinal fence is adapted to contact a longitudinal edge of sheets fed into the accumulator. A fixed cam is included in the roller assembly. A rotatable registration finger is mounted in contact with the cam. During rotation of the registration finger, interaction between the registration finger and the cam causes the registration finger to contact each sheet fed into the accumulator by the roller, and to exert force to urge each sheet toward the lateral fence and the longitudinal fence of the accumulator.

In an embodiment, the roller assembly includes a selectively rotating shaft. The cam is fixed with respect to the shaft, and the registration finger is mounted on the shaft. The registration finger can include a collar secured to the shaft, with a finger member adapted for contact with sheet material connected to the collar and a cam follower adapted for contact with the cam. The registration finger can be fabricated from a flexible plastic material such as urethane, and the cam can be provided as a shaft bushing.

A biasing mechanism can be provided in association with the registration finger and the cam. The biasing mechanism can be provided as a compression spring biasing the registration finger into contact with the cam.

A method of improving sheet registration in an imaging system including a roller assembly adapted to feed sheet material in the system into an accumulator is also provided. In a first step, a lateral fence is provided extending along a first edge of the accumulator. A longitudinal fence is provided extending along a second edge of the accumulator, the longitudinal fence being substantially perpendicular to the lateral fence. A cam is mounted adjacent to the roller assembly. A registration finger is placed in contact with the cam. Next, the roller assembly feeds individual sheets of sheet material to the accumulator, and the registration finger. Interaction of the cam and registration finger causes the registration finger to contact each sheet fed into the accumulator by the roller, thereby causing the registration finger to exert force to urge each sheet toward the lateral fence and the longitudinal fence of the accumulator.

The features of the invention believed to be patentable are set forth with particularity in the appended claims. The invention itself, however, both as to organization and method of operation, together with further objects and advantages thereof, may best be understood by reference to the following description taken in conjunction with the accompanying drawings.

DETAILED DESCRIPTION OF THE INVENTION

Figure 1:
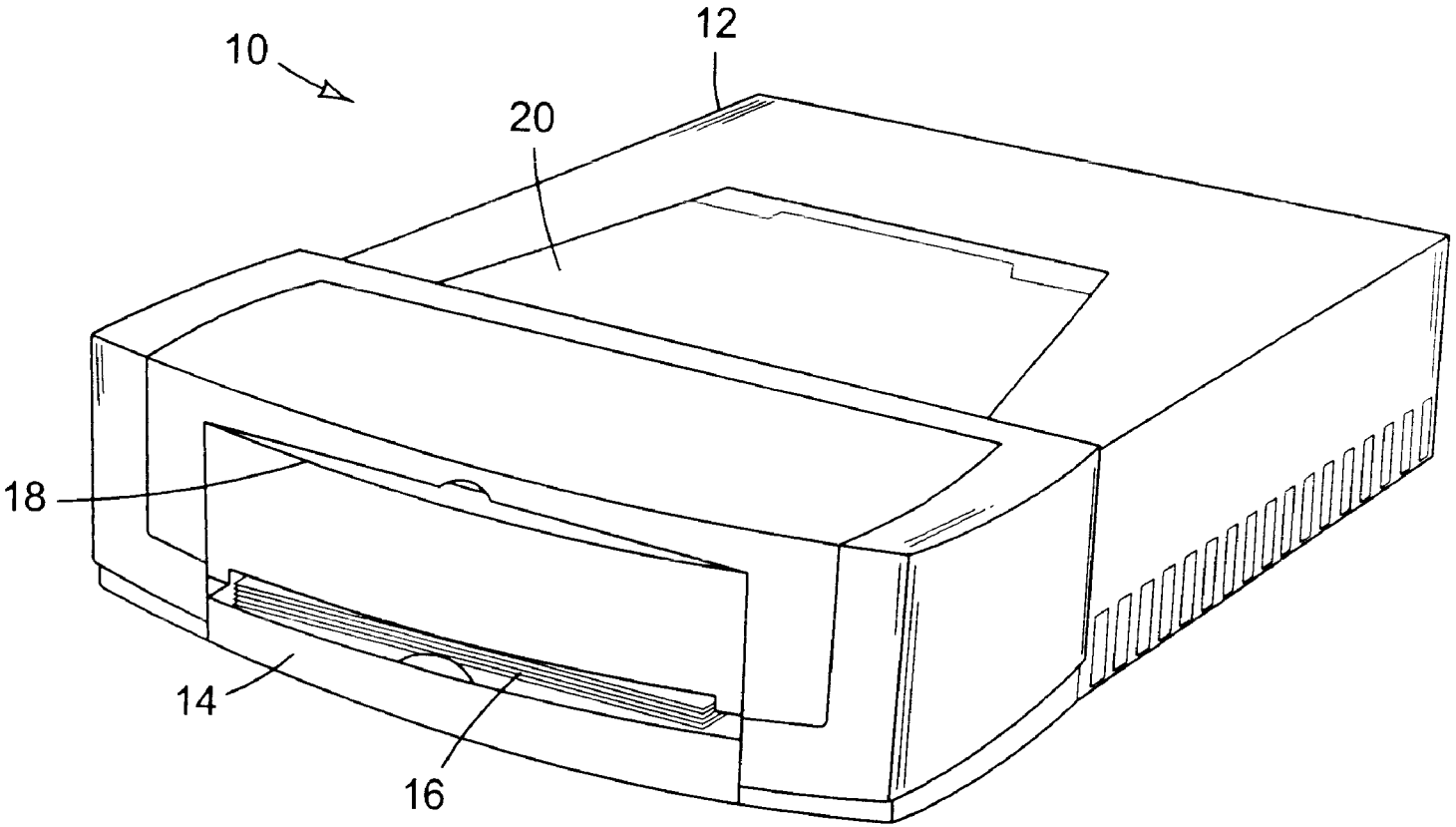
FIG. 1 is a schematic illustration of an imaging system having a registration assembly in accordance with the principles discussed herein.

An imaging system 10 in accordance with the principles of the present invention is illustrated in FIG. 1. Although the present invention is applicable to any sheet material handling system in which sheet stack registration in an accumulator is desirable, the imaging system 10 is herein illustrated as a low profile printer 12 including an accumulator, here shown as a paper output tray 14. The paper output tray 14 is coupled to the printer 12 to permit output of sheets of paper 16. Above the paper trays is a single sheet feed door 18, which is provided in addition to an automatic infeed mechanism (not shown). The top of the printer has an access door 20 for clearance of paper jams and the like when entry to the interior of the printer 12 is required. While this invention is described in terms of paper and paper sheets, it is intended that the invention encompass any sheet material which may be handled as individual or continuous sheets of such sheet material.

Figure 2:
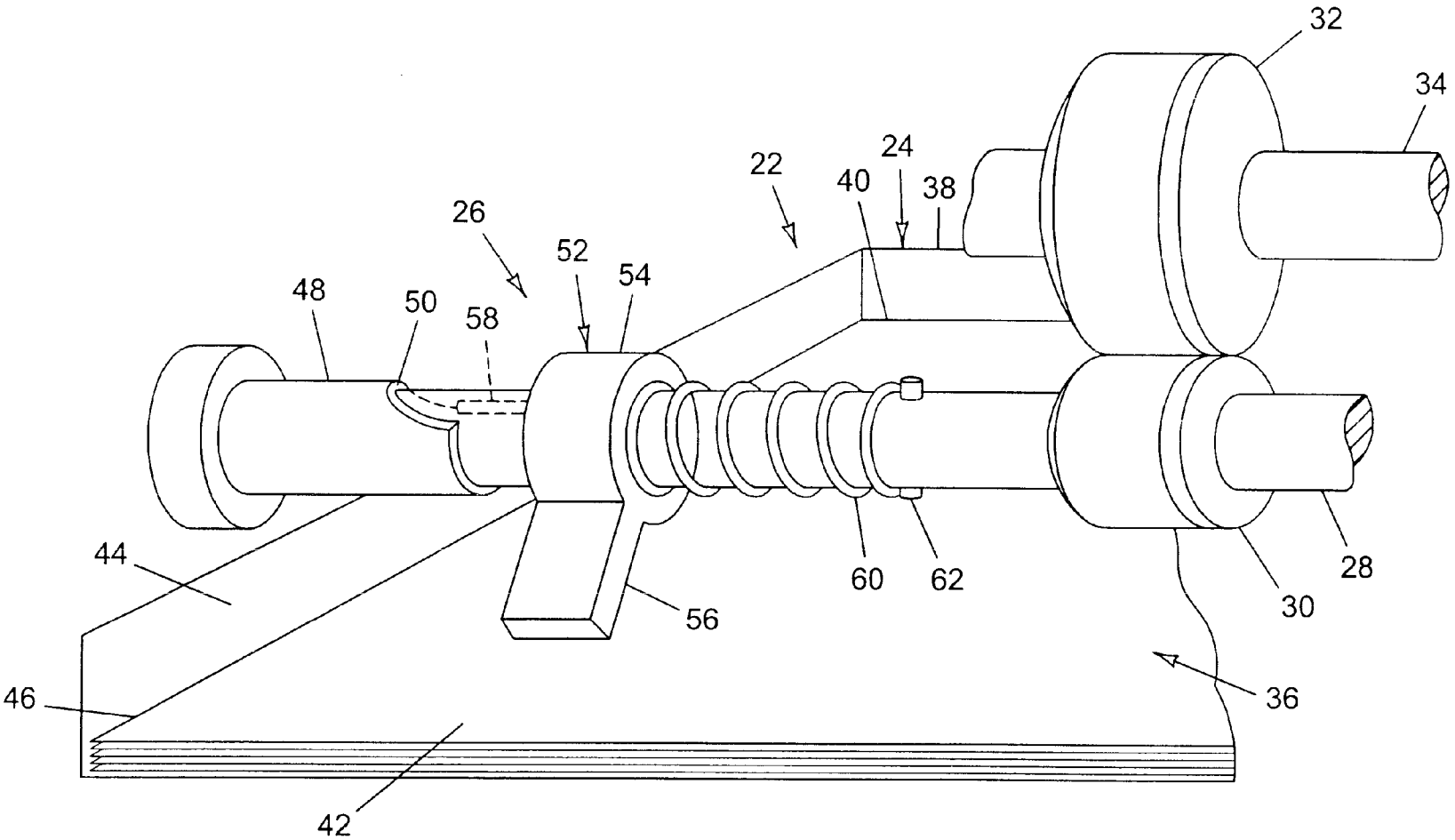
FIG. 2 is a schematic illustration of a roller assembly and accumulator incorporating a registration assembly in accordance with the principles discussed herein.

As seen in FIG. 2, the imaging system 10 includes an accumulator 22 including a tray 24 for receiving sheet material. A roller assembly 26 is provided to transport individual sheets of material into the tray 24. The roller assembly 26 includes a primary drive shaft 28 upon which is mounted one or more suitable drive members, such as a drive roller 30. The drive roller 30 is mounted in driving engagement with a driven roller 32, which is mounted on a secondary shaft 34.

A registration assembly 36 includes a lateral fence 38 extending along a first edge of the accumulator 22. The lateral fence 38 is adapted to contact a lateral edge 40 of sheets 42 fed into the accumulator 22. A longitudinal fence 44 extends along a second edge of the accumulator, and is substantially perpendicular to the lateral fence 38. The longitudinal fence 44 is adapted to contact a longitudinal edge 46 of the sheets 42 fed into the accumulator 22.

The registration assembly 36 also includes a cam 48, which is fixed with respect to the shaft 28, and includes a cam surface 50. The cam 48 can be provided as a bushing for the shaft 28.

A registration finger 52 is mounted on the shaft 28. The registration finger 52 includes a collar 54 secured to the shaft 28. A finger member 56 extends radially from the collar 54, and is adapted for contact with sheet material 42. A cam follower 58 extends axially from the collar 54 along the outer surface of shaft 28, and is adapted for contact with the cam surface 50 of the cam 48. The registration finger 52 can be fabricated from a flexible plastic material, such as urethane and the like. A biasing mechanism, here illustrated as a compression spring 60, biases the cam follower 58 of the registration finger 52 into contact with the cam surface 50. The compression spring 60 is shown as surrounding the shaft 28, and is held in place by a pin 62 passing through the shaft 28.

Figure 3:
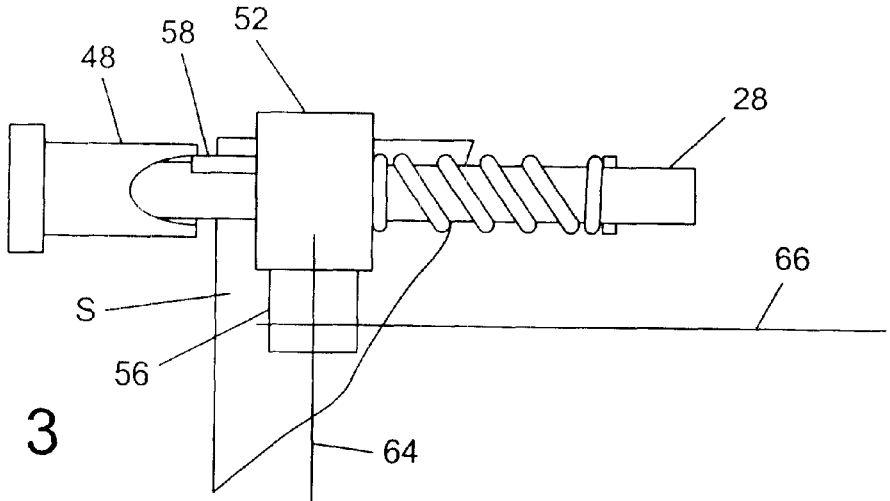
FIGS. 3 through 5 are schematic plan views illustrating operation of the registration assembly shown in FIG. 2.
Figure 4:
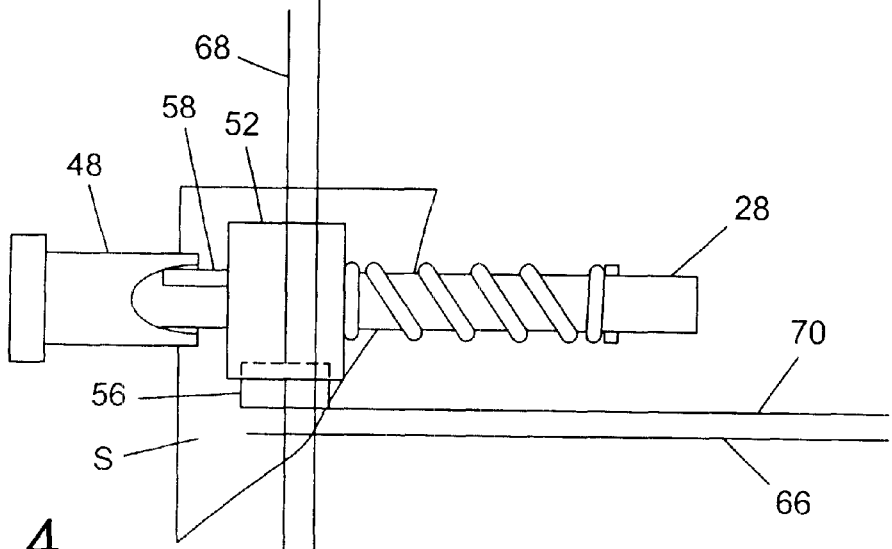
Figure 5:
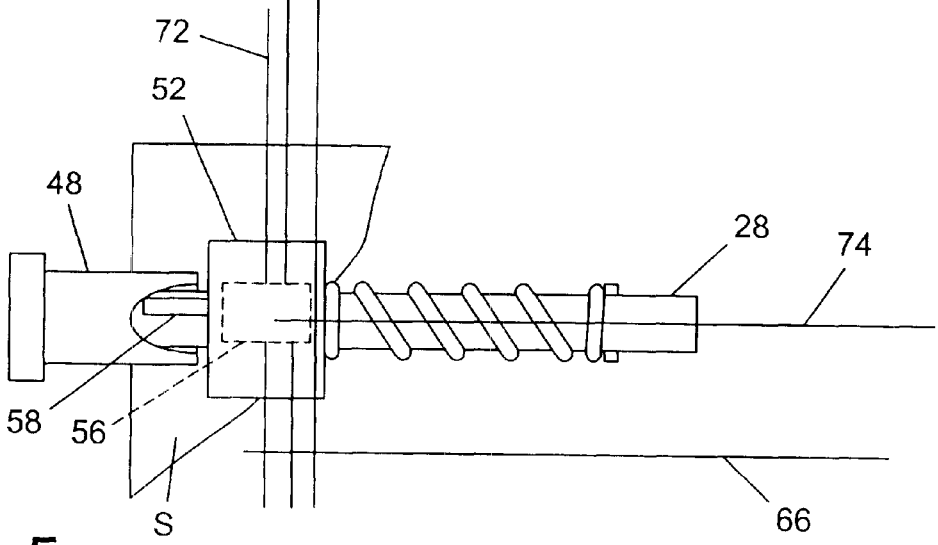

Operation of the registration assembly 26 is shown in FIGS. 3 through 5. The initial position of the registration assembly 26 is shown in FIG. 3. The finger member 56 is located at the intersection of initial longitudinal axis 64 and initial lateral axis 66.

As shown in FIG. 4, rotation of the shaft 28 causes the registration finger 52 to rotate. As the finger member 56 of the registration finger 52 comes into contact with a sheet of material S being fed into the accumulator 22, the cam follower 58 of the registration finger 52 travels along the cam surface 50 of the cam 48, moving the finger member 56 to the intersection of intermediate longitudinal axis 68 and intermediate lateral axis 70. This in turn causes the finger member 56 to exert force to urge the sheet S toward the lateral fence 38 and the longitudinal fence 44 of the accumulator 22 until, as shown in FIG. 5, the finger member 56 is at the intersection of final longitudinal axis 72 and final lateral axis 74, and the respective edges of the sheet S are in contact with the lateral fence 38 and the longitudinal fence 44 of the accumulator 22. As the secondary shaft 34 continues to rotate the registration assembly 26, the finger member 56 rotates out of contact with the sheet S, and the registration assembly 36 is returned to its original FIG. 3 position. The roller assembly 26 is then ready to receive additional sheet material, and the process described with reference to FIGS. 3 through 5 can be repeated as required.

It can thus be seen that the present invention significantly simplifies sheet registration by comparison to known jogger-type mechanisms, thereby reducing costs of manufacture and maintenance and increasing reliability. Although the present invention has been described with reference to specific embodiments, those of skill in the art will recognize that changes may be made thereto without departing from the scope and spirit of the invention as defined by the appended claims.

What is claimed is:

1. In an imaging system including a roller assembly adapted to guide sheet material in the system into an accumulator, a sheet registration assembly comprising the following:

a lateral fence extending along a first edge of the accumulator, the lateral fence adapted to contact a lateral edge of sheets fed into the accumulator;

a longitudinal fence extending along a second edge of the accumulator, the longitudinal fence adapted to contact a longitudinal edge of sheets fed into the accumulator;

a cam adapted for rotation with the roller assembly; and a registration finger in contact with the cam;

whereby interaction of the registration finger and the cam during rotation of the registration finger causes the registration finger to contact each sheet fed into the accumulator by the roller and to exert force to urge each sheet toward the lateral fence and the longitudinal fence of the accumulator.

2. A sheet registration assembly according to claim 1, wherein the roller assembly includes a selectively rotating shaft, and the registration finger is mounted on the shaft.

3. A sheet registration assembly according to claim 2, wherein the registration finger comprises the following:

a collar secured to the shaft;

a finger member adapted for contact with sheet material; and a cam follower adapted for contact with the cam.

4. A sheet registration assembly according to claim 3, wherein the cam comprises a shaft bushing.

5. A sheet registration assembly according to claim 1, further comprising a biasing mechanism associated with the registration finger and the cam.

6. A sheet registration assembly according to claim 5, wherein the biasing mechanism comprises a compression spring biasing the registration finger into contact with the cam.

7. A sheet registration assembly according to claim 1, wherein the registration finger is fabricated from a flexible plastic material.

8. A laser printer comprising the following:

an accumulator adapted to receive a plurality of sheets of material in a stack;

a roller assembly adapted to guide sheet material in the system into the accumulator, the roller assembly being mounted for rotation on a shaft;

a lateral fence extending along a first edge of the accumulator, the lateral fence adapted to contact a lateral edge of sheets fed into the accumulator;

a longitudinal fence extending along a second edge of the accumulator, the longitudinal fence adapted to contact a longitudinal edge of sheets fed into the accumulator;

a cam adapted for rotation with the roller assembly; and a registration finger in contact with the cam;

whereby interaction of the registration finger and the cam during rotation of the registration finger causes the registration finger to contact each sheet fed into the accumulator by the roller and to exert force to urge each sheet toward the lateral fence and the longitudinal fence of the accumulator.

9. A sheet registration assembly according to claim 8, wherein the registration finger comprises the following:

a collar secured to the shaft;

a finger member adapted for contact with sheet material; and a cam follower adapted for contact with the cam.

10. A sheet registration assembly according to claim 8, wherein the registration finger is mounted on the shaft of the roller assembly.

11. A sheet registration assembly according to claim 10, wherein the cam comprises a shaft bushing.

12. A sheet registration assembly according to claim 8, further comprising a biasing mechanism associated with the registration finger and the cam.

13. A sheet registration assembly according to claim 12, wherein the biasing mechanism comprises a compression spring biasing the registration finger into contact with the cam.

14. A sheet registration assembly according to claim 8, wherein the registration finger is fabricated from a flexible plastic material.

15. In an imaging system including a roller assembly adapted to feed sheet material in the system into an accumulator, a method of improving sheet registration, the method comprising the following steps:

providing a lateral fence extending along a first edge of the accumulator;

providing a longitudinal fence extending along a second edge of the accumulator, the longitudinal fence being substantially perpendicular to the lateral fence;

mounting a cam for rotation with the roller assembly;

providing a registration finger in contact with the cam;

causing the roller assembly to feed individual sheets of sheet material to the accumulator;

whereby interaction of the registration finger and the cam during rotation of the registration finger causes the registration finger to contact each sheet fed into the accumulator by the roller and to exert force to urge each sheet toward the lateral fence and the longitudinal fence of the accumulator.

16. A method according to claim 15, wherein the roller assembly includes a selectively rotating shaft, the step of mounting a cam for rotation with the roller assembly comprises mounting the cam adjacent to the shaft.

17. A method according to claim 16, wherein the step of providing a registration finger comprises the following:

providing a registration finger including a collar secured to the shaft;

providing a finger member adapted for contact with sheet material; and providing a cam follower adapted for contact with the cam.

18. A method according to claim 17, wherein the step of mounting a cam adjacent to the roller assembly comprises mounting a bushing on the shaft, the bushing including a cam surface.

19. A method according to claim 15, further comprising the step of securing a biasing mechanism acting on the registration finger and the cam.

20. A method according to claim 19, wherein the step of securing a biasing mechanism comprises securing a compression spring biasing the registration finger into contact with the cam between the registration finger and the cam.

* * * * *